United States Patent [19]

Martelli

[11] 4,214,742

[45] Jul. 29, 1980

[54] DEVICE FOR FEEDING SHEETS TO BOXING MACHINES

[76] Inventor: Guglielmo Martelli, Via Gaibola, 13/3°, Bologna, Italy

[21] Appl. No.: 956,015

[22] Filed: Oct. 30, 1978

[30] Foreign Application Priority Data

Nov. 7, 1977 [IT] Italy ..... 3594 A/77

[51] Int. Cl.[2] ..... B65H 29/68

[52] U.S. Cl. ..... 271/69; 271/204

[58] Field of Search ..... 271/69, 202, 204, 205, 271/206, 277

[56] References Cited

U.S. PATENT DOCUMENTS

| | | | |
|---|---|---|---|
| 1,329,936 | 2/1920 | Spiess | 271/205 |
| 3,955,667 | 5/1976 | Müller | 271/204 X |

*Primary Examiner*—Richard A. Schacher

[57] ABSTRACT

A device for feeding sheets to boxing machines comprises a pair of endless flexible elements retaining therebetween the sheets to be fed to the boxing machine, a conveyor for the products to be fed to the boxing machine which supports a plurality of compartments uniformly distributed on it and open transversely to the movement direction thereof, a grip associated with each compartment, a driving motor effective to drive the flexible elements at a velocity greater than that of the conveyor and cam means to cause the grip to engage the sheets.

5 Claims, 3 Drawing Figures

II 1
2
3
4
5
6
7
8
9
10
11
12
13
15
16
17
18
19
20
21
22
23
24
25
26
27
28
29
30
33
37
39
39
41
47
48
49
A
B
C
D
II

DEVICE FOR FEEDING SHEETS TO BOXING MACHINES

BACKGROUND OF THE INVENTION

This invention relates to a device for feeding sheets to boxing machines.

In boxing machines, there is the known problem of inserting into the box, together with the product, a sheet containing the instuctions for its use. This problem is solved at the present time by causing the sheet to be folded an pushed by the product as it is thrust into the box.

The devices used at present for positioning the sheets between the product and the inlet mouth of the respective box are very complicated, because of the fact that the sheets are often previously foled into several parts and thus require careful manipulation, and because they can be of various shapes to conform to the various formats of the box, thus requiring suitable setting adjustments to be made.

SUMMARY OF THE INVENTION

The main object of the present invention is to propose a new device which obviates the drawbacks of known equipment, and which also has a simple, highly reliable structure which is of very low cost on consideration of its performance.

This and further objects, which will be more apparent hereinafter, are attained by a device for feeding sheets to boxing machines, characterized in that it comprises a pair of flexible members driven with continuous motion and disposed in endless configuration about respective idle rollers in such a manner as to comprise two portions in which said flexible members are adjacent to each other to retain therebetween the sheets to be fed to the boxing machine and originating from a store, such that a part of said sheets projects laterally, one of said portions describing a path which is inclined downwards, followed by a horizontal portion which forms an obtuse angle with the inclined portion, a conveyor for the products to be fed to the boxing machine, which moves with continuous motion parallel to said horizontal portion and supports a plurality of compartments uniformly distributed on it and open transversely to the direction of movement of the conveyor, said compartments having a base substantially coplanar with said horizontal portion, a grip associated with each compartment, means for driving said flexible members at a velocity greater than that of the conveyor and such that the horizontal component of the velocity along said inclined portion is equal to that of the conveyor so as to enable the projecting part of the sheets to penetrate between the compartments without interfering therewith as the sheets pass along the inclined portion, and then to accelerate to reach the grip of the front compartment, and cam means to cause the grip to grip said projecting portion in proximity to the end of said horizontal portion.

BRIEF DESCRIPTION OF THE DRAWINGS

Further details will be more apparent from the description given hereinafter of one embodiment of the invention, illustrated by way of example in the accompanying drawings, in which.

DESCRIPTION OF THE PREFERRED EMBODIMENT

Figure 1:
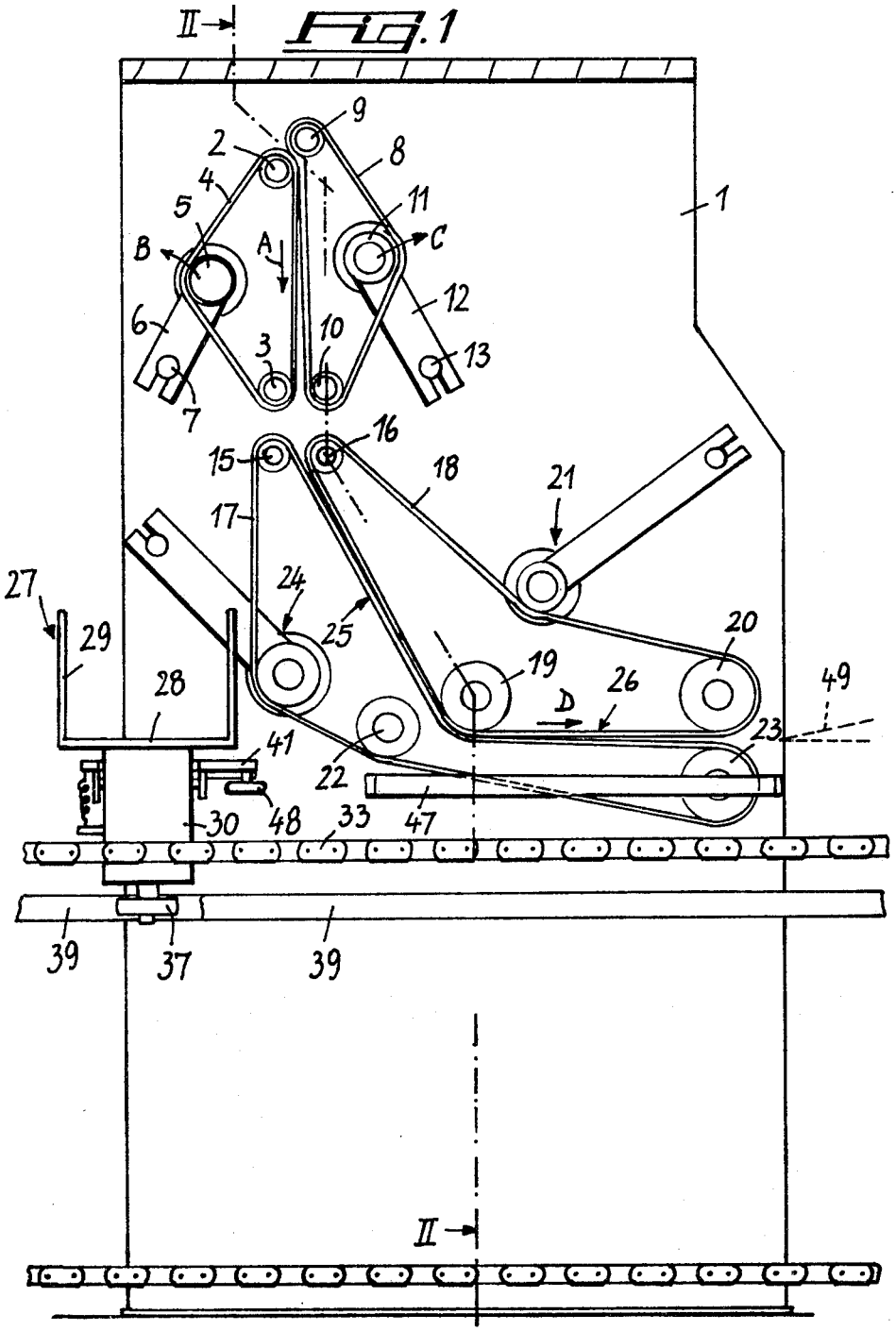
FIG. 1 is a side elevation of the device according to the invention.

With reference to said figures, the reference numeral 1 indicates the base of the device, constituted essentially by a box side frame which contains all the mechanisms for transmitting motion to the various parts of the device.

The reference numerals 2, 3 indicate a pair of rollers lying in a vertical plane, and about which a pair of endless flat belts 4 is disposed. The roller 3 is driven such that the belts move in the direction of the arrow A. A jockey pulley is provided for tensioning the belts 4, and is in the form of a roller 5 supported idly at the end of an arm 6, which is fixed at its other end on to a pin 7 rotatably supported in the base 1. The arm 6 is urged in the direction B by resilient means, which are not visible on the drawing but are easily imaginable.

A second pair of belts 8 is disposed about a further pair of rollers 9, 10 and a jockey roller 11 supported by an arm 12 hinged on a pin 13 and also urged in the direction C by spring means, not shown.

Figure 2:
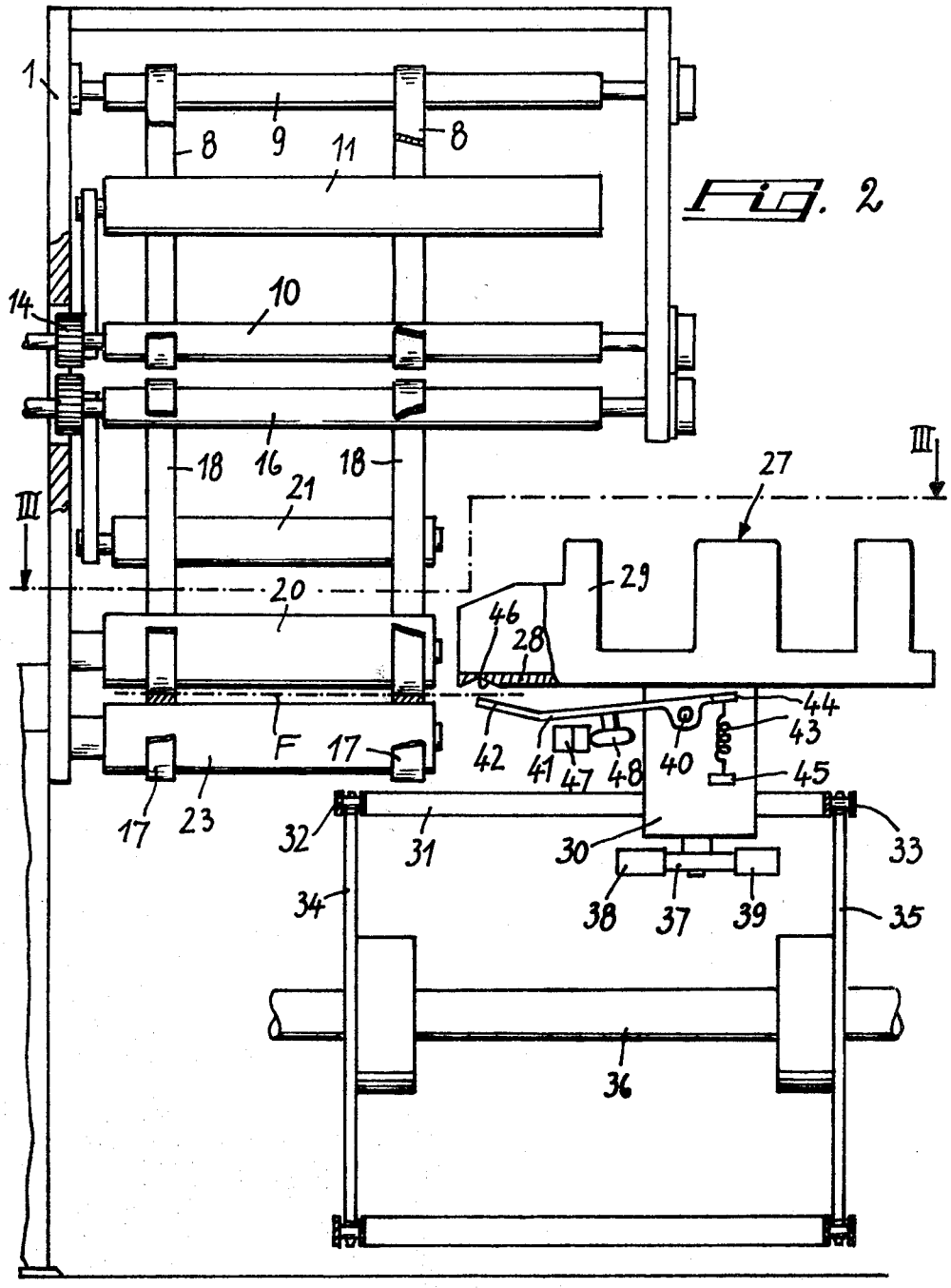
FIG. 2 is a side elevation on the line II—II of FIG. 1.

The rollers 3, 10 are coupled together by gears keyed on respective axles, of which FIG. 2 shows only that rigid with the roller 10 and indicated by 14. Because of this gearing, the belts 8 also move in the direction A.

The rollers 3, 10 are at the same level, whereas the roller 9 is at approximately 45° above the roller 2 with which it is in contact so as to form an oblique lead-in for the entry of the sheets originating from a store of known type. Those portions of the belts 4, 8 lying between the pair of upper rollers 2, 9 and the pair of lower rollers 3, 10 are adjacent to each other in such a manner as to retain the sheets which, after withdrawing from the store and possibly already folded into the required format, are led one by one between the rollers 2, 9.

Below the rollers 3, 10 are disposed further idle rollers 15, 16 for two further pairs of belts 17, 18. The belts 18 are disposed endless about two rollers 19, 20 disposed in a horizontal plane and correctly tensioned by a jockey roller 21 analogous to those indicated by 5 and 11, and acting on the belts 18 from the outside. The planes passing through the axes of the rollers 16, 19 and 19, 20 define an obtuse angle therebetween.

The pair of belts 17 passes both over the roller 15 and over the rollers 22, 23, the second of which lies immediately below the roller 20 and forms a tangent thereto. The jockey roller 24 gives the belts 17 their correct tension, and the roller 22 helps to prevent the lower part of the belts 17 coming into sliding contact with the upper part.

The rollers 20, 23 are connected together and to the drive, so as to cause the belts 17, 18 to move in the direction D.

It should be noted that because of the arrangement of the rollers 15, 16, 19, 20, 23, the belts 17, 18 are adjacent along two portions, one of which, indicated by 25, is inclined and forms an angle greater than 90° with the other horizontal portion 26. The compartments 27 containing the products to be inserted into the boxes, and with which the sheets are to be associated, move to the front of the idle rollers for the belts 17, 18. These products are for example bottles or containers of another kind. As can be seen from FIGS. 2, 3, each compartment 27 is formed from a rectangular base 28 lying at the level defined by the horizontal portion 26 of the belts 17, 18, from the edges of which rise two shaped sides 29 parallel to the roller axes.

The compartment 27 is fixed on a member 30 slidably guided on a rod 31 of square cross-section, the two ends of which are rigid with respective parallel chains 32, 33. The chains 32, 33 pass over pairs of sprockets, of which FIG. 2 shows the pair 34, 35 keyed on to a shaft 36.

The chains 32, 33 and rods 31 form the conveyor for conveying the compartments 27 containing the containers G to be inserted into the boxes, and which moves with continuous motion in the direction D, but at a speed less than that of the belts 17, 18 along the portion 26. The compartments 27 are caused to move along the rods 31 by engagement with an idle roller 37 mounted under the member 30, between two rails 38, 39 which extend along a predetermined trajectory. In particular, on following the path of said rails 38, 39, the compartment 27 is made to frontally approach the rollers 19, 20, 23, such that the front edge of the base 28 lies in a plane slightly higher than the plane of contact between the belts 17, 18 along the portion 26.

A type of grip 41 is hinged below the compartment 27 on a pin 40 of the member 30, and is composed of a plate with a front edge 42 bent upwards. By means of a tension spring 43 hooked at one end to a projection 44 on the plate and at the other end to a bracket 45 on the member 30, the front edge 42 is urged against the base 28 where it engages with a groove 46 provided in this latter. Thus, in practice the grip is composed of the plate 41 and base 28.

The opening of the grip is controlled by a straight cam 47, the edge of which is engaged by a roller 48 idly supported on the plate 41.

The portion of the cam 47 lying between the rollers 19 and 20 extends parallel to the direction D. Over this portion, the grip 41 remains open.

The operation of the described device is as follows. It will be assumed that the velocity of movement of the belts 17, 18 exceeds that of the compartment conveyor 31–33, and the inclination of the portion 25 is such that the horizontal component of the velocity is equal to that of said conveyor.

The instruction sheets originating from the store are taken by the belts 4, 8, and transferred between the belts 17, 18 which convey them downwards.

Figure 3:
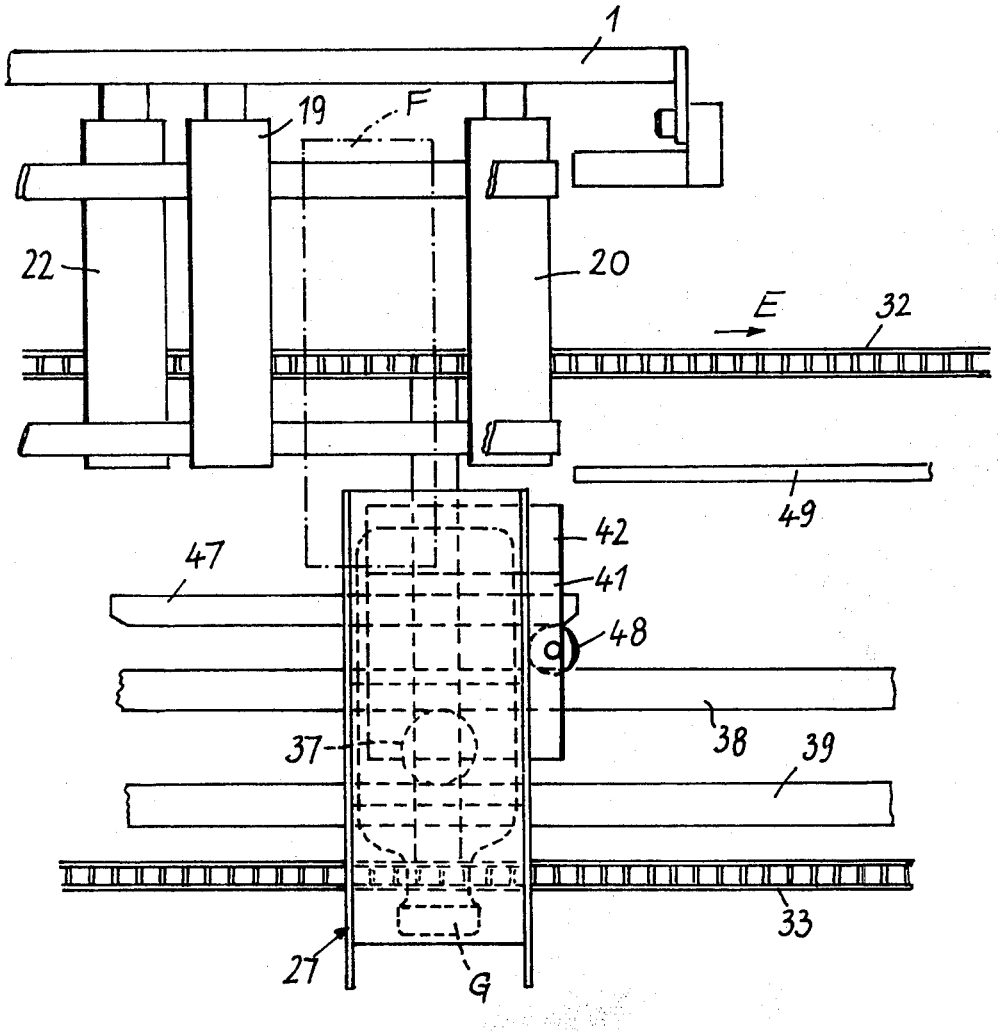
FIG. 3 is a plan view on the line III—III of FIG. 2.

It is clear from FIG. 3, which shows one example of a sheet F as dashed and dotted lines, that the sheets project by one end beyond the front end of the rollers. To prevent the projecting ends of the sheets F coming into contact with the compartments as the sheets descend along the portion 25, they are withdrawn from the store at a stage in the movement of the compartments such that they can descend between the compartments. It should be noted that as the horizontal component of the descent velocity of the sheets has been chosen equal to the velocity of movement of the compartments, the sheets remain perfectly equidistant from the compartments between which they descend, along the portion 25. As soon as the sheets enter the horizontal portion 26, their velocity of forward movement is greater than that of the compartments, such that each sheet reaches the compartment in front of it. Because of the engagement between the roller 48 and cam 47, the grip 41 is kept in an open position along the portion 26, so enabling the side end of the sheet F to penetrate between the base 28 and edge 42. When the compartment has reached the rollers 20, 23, the roller 48 abandons the cam 47, and the grip 41 closes by the action of the spring 43, to grip the sheet F and hold it against the groove 46. On further movement of the compartment, the sheet abandons the belts 17, 18, and is brought into engagement with a fixed folder 49 which folds it upwards so as to close the compartment 27 on the side adjacent to the rollers 20, 23. Under the influence of the rails 38, 39, the compartments then move laterally along the rods 31 and are brought into alignment with the boxes transferred by a parallel conveyor, such that each upward folded sheet F is disposed between the compartment with which it is associated, and the inlet mouth of a relative box. Finally, suitable pusher means transfer the containers G, contained in the compartment, into the box as the grip 41 simultaneously opens. The transfer of the containers G causes the sheets to be simultaneously inserted, and these become wrapped in U form about the base of the containers.

According to one modification of the invention, the means which bring the sheets into association with the relative compartments can be constituted by an endless flexible member provided with retention members for the individual sheets, for example a chain provided with grips able to retain the sheets in a predetermined position.

Obviously, the flexible member will have a trajectory substantially identical to that of the belts 18. The grip operation can be controlled by stationary cams.

I claim:

1. A device for feeding sheets to boxing machines, characterized in that it comprises a pair of flexible members driven with continuous motion and disposed in endless configuration about respective idle rollers in such a manner as to comprise two portions in which said flexible members are adjacent to each other to retain therebetween the sheets to be fed to the boxing machine and originating from a store, such that a part of said sheets projects laterally, one of said portions describing a path which is inclined downwards, followed by a horizontal portion which forms an obtuse angle with the inclined portion, a conveyor for the products to be fed to the boxing machine, which moves with continuous motion parallel to said horizontal portion and supports a plurality of compartments uniformly distributed on it and open transversely to the direction of movement of the conveyor, said compartments having a base substantially coplanar with said horizontal portion, a grip associated with each compartment, means for driving said flexible members at a velocity greater than that of the conveyor and such that the horizontal component of the velocity along said inclined portion is equal to that of the conveyor so as to enable the projecting part of the sheets to penetrate between the compartments without interfering therewith as the sheets pass along the inclined portion, and then to accelerate to reach the grip of the front compartment, and cam means to cause the grip to grip said projecting portion in proximity to the end of said horizontal portion.

2. A device as claimed in claim 1, wherein said flexible members are constituted by pairs of flat belts disposed in endless configuration about idle rollers such as to comprise two portions in which the belts are adjacent to each other to retain the sheets which have been withdrawn from a store and transferred between them by a further feed belt.

3. A device as claimed in claim 2, wherein said conveyor comprises a pair of parallel chains disposed about pairs of sprockets and driven with continuous motion, they being connected together by transverse rods on which the compartments containing the products are guided.

4. A device as claimed in claim 3, wherein said grip comprises a type of plate hinged below the compartment and driven between an open position and a closed position by a stationary cam arranged for engagement by a roller supported by said plate, resilient means being provided to keep said roller engaged with the cam.

5. A device as claimed in claim 4, wherein the cam which controls said roller extends through a length substantially equal to that of the horizontal portion of the flexible members.

* * * * *